US011771297B1

(12) United States Patent
James

(10) Patent No.: US 11,771,297 B1
(45) Date of Patent: Oct. 3, 2023

(54) FLOOR CLEANING DEVICE

(71) Applicant: Vivienne James, Ft Lauderdale, FL (US)

(72) Inventor: Vivienne James, Ft Lauderdale, FL (US)

( * ) Notice: Subject to any disclaimer, the term of this patent is extended or adjusted under 35 U.S.C. 154(b) by 95 days.

(21) Appl. No.: 17/538,727

(22) Filed: Nov. 30, 2021

Related U.S. Application Data

(63) Continuation-in-part of application No. 16/747,640, filed on Jan. 21, 2020, now abandoned.

(51) Int. Cl.

| | |
|---|---|
| ***A47L 13/62*** | (2006.01) |
| ***A41D 13/06*** | (2006.01) |
| ***A47L 13/16*** | (2006.01) |
| ***A47L 13/29*** | (2006.01) |

(52) U.S. Cl.
CPC ..... *A47L 13/62* (2013.01); *A41D 13/065* (2013.01); *A47L 13/16* (2013.01); *A47L 13/29* (2013.01)

(58) Field of Classification Search
CPC ..... A47L 13/16; A47L 13/20; A47L 13/28; A47L 13/29; A47L 13/62; A41D 13/06; A41D 13/065; A41D 2600/20
See application file for complete search history.

(56) References Cited

U.S. PATENT DOCUMENTS

| | | | | |
|---|---|---|---|---|
| 6,122,793 | A * | 9/2000 | Pao | A47L 13/20 36/7.1 R |
| 2016/0278455 | A1* | 9/2016 | Johnson | A41D 13/065 |
| 2017/0006934 | A1 | 1/2017 | Miller | |
| 2018/0168247 | A1 | 6/2018 | Troxell | |

FOREIGN PATENT DOCUMENTS

| | | | |
|---|---|---|---|
| JP | 2000-107111 | A * | 4/2000 |
| JP | 2002-291671 | A * | 10/2002 |
| JP | 2009-213839 | A * | 9/2009 |

* cited by examiner

*Primary Examiner* — Randall E Chin
(74) *Attorney, Agent, or Firm* — SANCHELIMA & ASSOCIATES, P.A.; Christian Sanchelima; Jesus Sanchelima

(57) ABSTRACT

A system for a cleaning device including a knee pad assembly and a cleaning assembly is disclosed. The knee pad assembly includes knees pads that include a cushion for providing protection to the knees of the user. Further, the knee pads include attaching members that allow for the cleaning assembly to be removably mounted to the knee pads. The cleaning assembly includes at least one cleaning cloth that includes attaching members that cooperates with the attaching members of the knee pads to removably attach the at least one cleaning cloth to the knee pads. Thereby allowing the user wearing the knee pads to complete necessary task while on their knees and clean the floor at the same time. The system for the cleaning device provides protection and safety to the user in addition to increasing the efficiency of the user.

9 Claims, 3 Drawing Sheets

FLOOR CLEANING DEVICE

OTHER RELATED APPLICATIONS

The present application is a continuation-in-part of pending U.S. patent application Ser. No. 16/747,640, filed on Jan. 21, 2020, now abandoned, which is hereby incorporated by reference.

BACKGROUND OF THE INVENTION

1. Field of the Invention

The present invention relates to a floor cleaning device and, more particularly, to a floor cleaning device that includes knee pads, to be worn by a user, having detachable cleaning cloths, allowing the user to move around on their knees and clean at the same time.

2. Description of the Related Art

Several designs for floor cleaning devices have been designed in the past. None of them, however, include a floor cleaning device comprising knee pads having hook and loop straps on the outside for removably attaching microfiber cleaning cloths. There are times when workers must work on their knees to complete certain tasks at work and such work becomes bothersome on the knees after prolonged periods of time. Advantageously, with the present invention the user may have their knee protected while also being able to clean the floor as they move along the floor on their knees to complete necessary tasks. Thereby allowing the user to be more efficient and effective during necessary tasks.

Applicant believes that a related reference corresponds to U.S. patent No. 2018/0168247 for a knee pad that is secured around the leg with Velcro straps. Applicant believes another related reference corresponds with U.S. No. 2017/0006934 for a knee pad assembly for protecting a knee of a construction worker. The device includes a Velcro or zipper belt that is fixedly connected with one side of the kneecap body. None of these references, however, teach of a cleaning device that includes knee pads having hook and loop straps on the outside for removably attaching cleaning cloths thereto.

Other documents describing the closest subject matter provide for a number of more or less complicated features that fail to solve the problem in an efficient and economical way. None of these patents suggest the novel features of the present invention.

SUMMARY OF THE INVENTION

It is one of the objects of the present invention to provide a cleaning device that includes knee pads that are cushioned to provide protection to the knees of the user.

It is another object of this invention to provide a cleaning device that includes removably attachable cloths for cleaning a surface.

It is still another object of the present invention to provide a cleaning device that is reusable.

It is yet another object of this invention to provide a cleaning device that includes interchangeable cleaning cloths.

It is yet another object of this invention to provide such a device that is inexpensive to implement and maintain while retaining its effectiveness.

Further objects of the invention will be brought out in the following part of the specification, wherein detailed description is for the purpose of fully disclosing the invention without placing limitations thereon.

BRIEF DESCRIPTION OF THE DRAWINGS

With the above and other related objects in view, the invention consists in the details of construction and combination of parts as will be more fully understood from the following description, when read in conjunction with the accompanying drawings in which.

DETAILED DESCRIPTION OF THE EMBODIMENTS OF THE INVENTION

Figure 1:
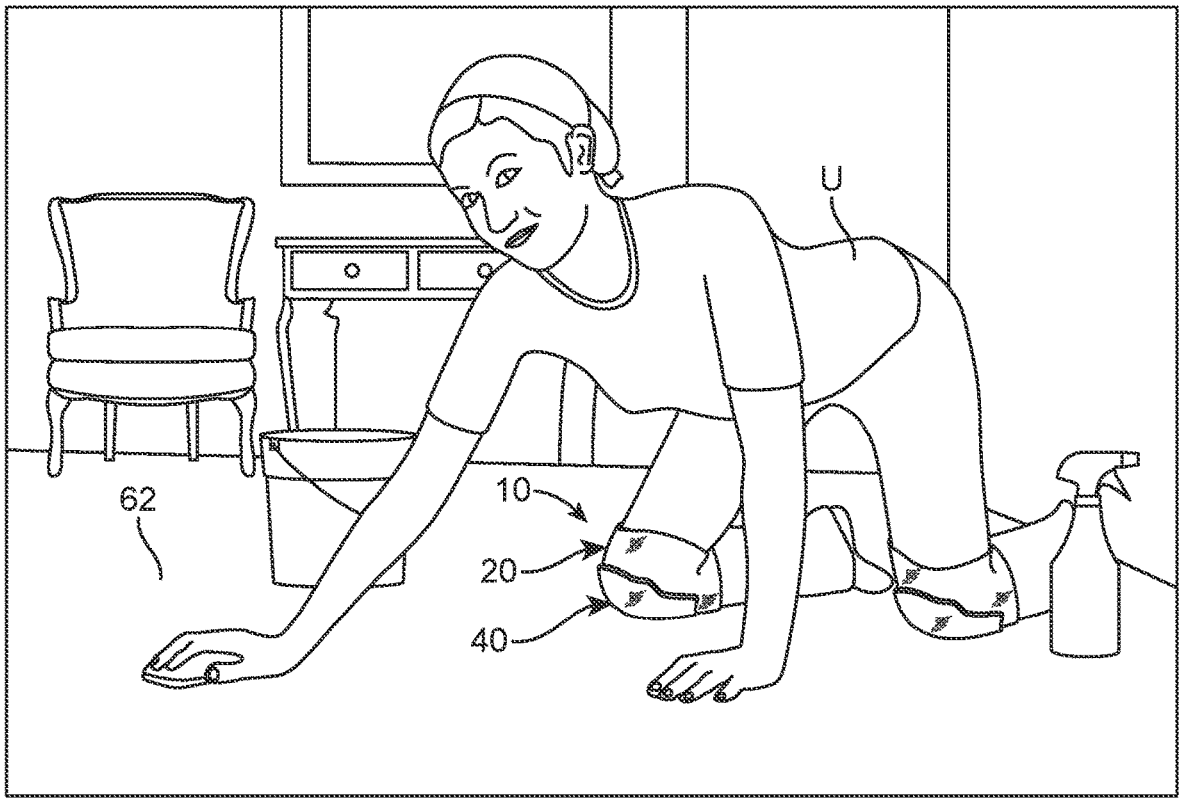
FIG. 1 represents the cleaning device 10 in an operational setting in which a user U is cleaning a ground surface 62.

Referring now to the drawings, where the present invention is generally referred to with numeral 10, it can be observed that it, a cleaning device 10, basically includes a knee pad assembly 20 and a cleaning assembly 40.

There is often a need to complete work or tasks while on the knees and on a floor. This, however, can be painful to a person if done for a prolonged period of time. The present invention helps to reduce that pain and discomfort to a user U and further increase the efficiency of user U by providing cleaning means on the present invention. Thereby, resulting in user U having their knees protected and as user U moves along the floor, the floor is also cleaned.

Figure 2:
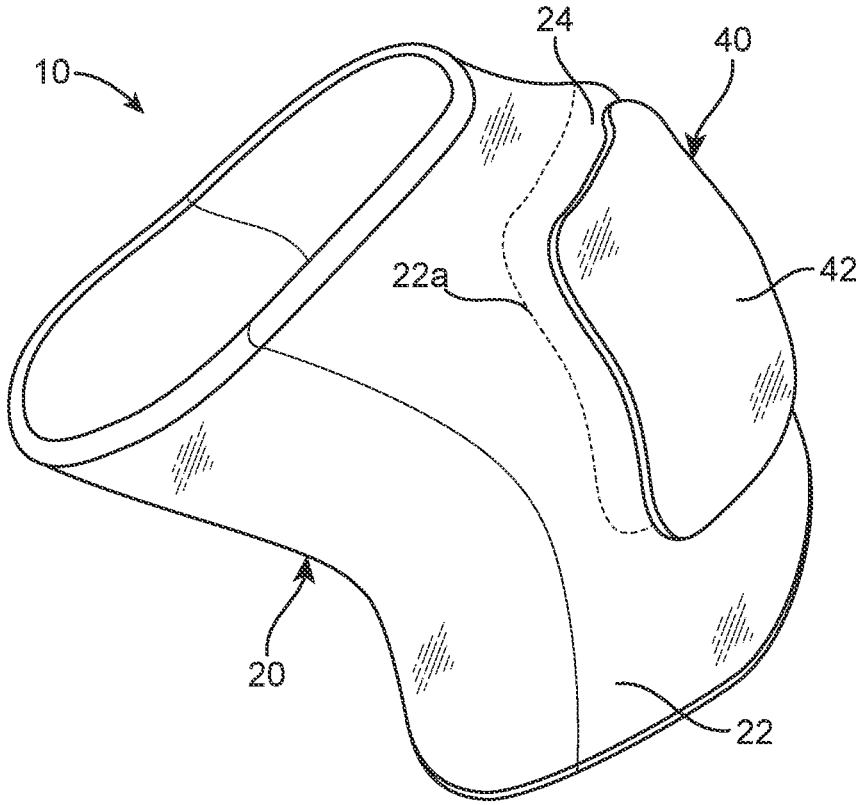
FIG. 2 shows an isometric view of the floor cleaning device 10, in accordance with an embodiment of the present invention.
Figure 3:
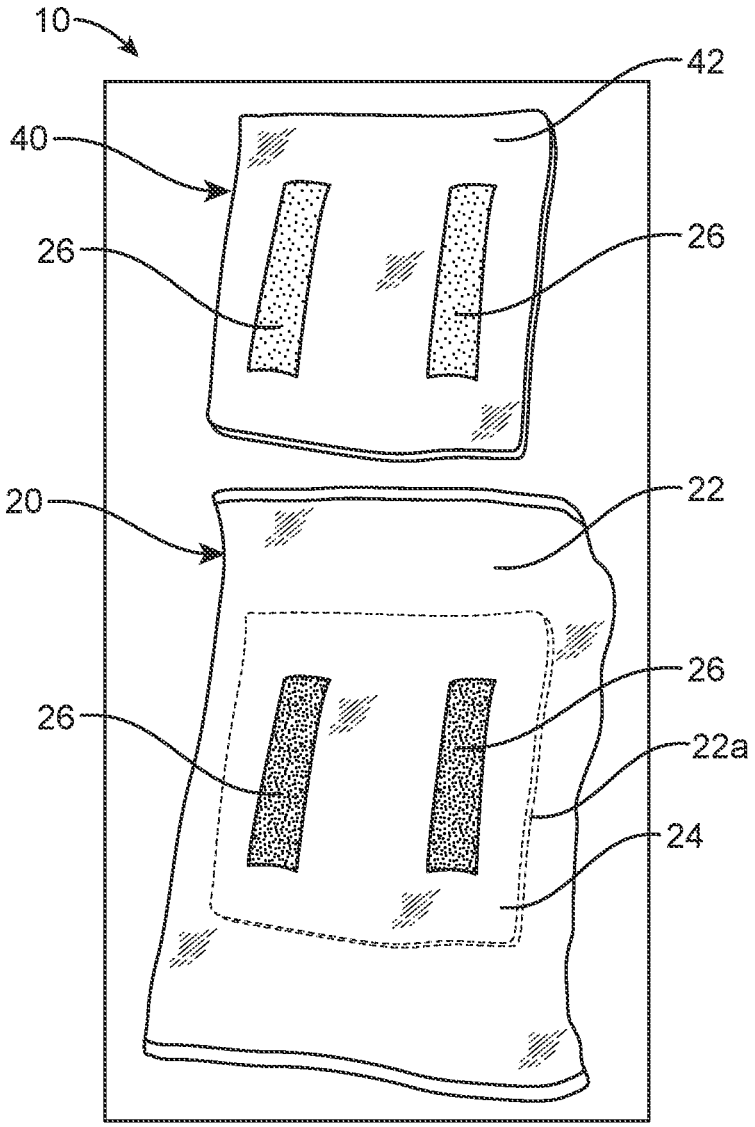
FIG. 3 illustrates the attaching mechanism of the present invention on both the knee pad assembly 20 and cleaning assembly 40, which cooperate with one another.

The present invention can be best seen in FIG. 1-3. It can be seen that knee pad assembly 20 includes knee pads 22 which may be worn by user U. Knee pads 22 may be of a predetermined shape and dimension. Knee pads 22 may be slipped, preferably, around the knees of user U by pulling them from each foot upwardly through a through opening. Knee pads 22 may be whole yet easily secured to user U due to elastics that may be found about the perimeter of the distal ends of knee pads 22. The elastic bands may allow for knee pads to adjust to different users easily. Knee pads 22 may be worn around the knees or other body parts as is suitable in the art. In the immediate embodiment, there may be two of knee pads 22. However, it should be understood that at least one of knee pads 22 may be suitable as well. It may be suitable for knees pads 22 to be made of breathable materials or fabrics to provide comfort to user U during usage. Knee pads 22 may suitably be made of cotton, linen, rayon, cambric, silk, polyester, spandex, nylon or combinations thereof. It should be understood that knee pads 22 may have elastic and be capable of stretching to cooperate with users of different shapes and sizes. It should be understood that knee pads 22 may be reusable and also washable for sanitation purposes. It can be seen that knee pads 22 may include a cushion 24 on a front side thereof. Preferably, cushion 24 may be within knee pads 22 on the front side of knee pads 22. Knee pads 24 further includes a stitching 22*a*. Stitching 22*a* completely surrounds the cushion 24. Stitching 22*a* defines four perimeter edges of the cushion 24. Cushion 24 may provide comfort and protection to user U as knee pads 22 are being worn. Cushion 24 may be adapted to provide padding to the user U. Preferably, knee pads 22 are worn around the knees and cushion 24 provides protection and cushioning to the knees. Cushion 24 may be of dimensions and shape that cooperates with knee pads 22. Cushion 24 may be made of foam, rubber, plastic, gel, carbon fiber or other suitable materials. Cushion 24 should be soft enough to absorb impact and pressure from being on the knees while user U is wearing knee pads 22. Knee pads 22 may further include attaching members 26 on an outer surface thereof. Attaching members 26 are located entirely within the four perimeter edges defined by said stitching 22*a*. Preferably, attaching members 26 may be on the front side of knee pads 22. Attaching members 26 may preferably be hook and loop straps. However, it should be understood that, in an alternate embodiment, attaching members 26 may be an adhesive, fasteners, buttons, snap buttons or other suitable means for attaching as known in the art. The present invention may include two of attaching members 26, however, at least one of attaching members 26 may be suitable as well. Attaching members 26 may be oriented vertically and parallel. However, it should be understood that attaching members 26 may have any predetermined orientation. It may be suitable for attaching members 26 to be oriented horizontally, for example. Knee pad assembly 20 may allow user U to wear the present invention and further to provide protection to user U.

Cleaning device 10 further includes cleaning assembly 40. Cleaning assembly 40 may be mounted to knee pad assembly 20. Cleaning assembly 40 may be used to clean a ground surface 62. Ground surface 62 may be a floor. Cleaning assembly 40 may include at least one cleaning cloth 42. At least one cleaning cloth 42 may preferably be made of microfiber. However, at least one cleaning cloth 42 may be made of bristles, nylon mesh, metal mesh, plastic mesh, soft sponge-like materials or other suitable materials that may be used for cleaning and scrubbing ground surface 62. It should be understood that at least one cleaning cloth 42 may be absorbent as well. At least one cleaning cloth 42 may be interchangeable in the present invention depending on the appropriate one of at least one cleaning cloth 42 to be used for the cleanup task by user U. As a result, the present invention may include multiple cleaning cloths. It should be understood that each of at least one cleaning cloth 42 may be made of a different material. Preferably, each of at least one cleaning cloth 42 may be washable and reusable. At least one cleaning cloth 42 may further include attaching members 26 on a bottom surface thereof. Attaching member 26 on at least one cleaning cloth 42 may cooperate with attaching members 26 on knee pads 22. Attaching members 26 on knee pads 22 and at least one cleaning cloth 42 may be the same type or kind. Attaching members 26 allow for each of at least one cleaning cloth 42 to be removably mounted to knee pads 22. It should be understood that at least one cleaning cloth 42 may be of a predetermined shape and dimensions. Preferably, at least one cleaning cloth 42 may be within the periphery boundaries of knee pads 22. When at least one cleaning cloth 42 is being dragged, rubbed or in contact with ground surface 62, ground surface 62 may be cleaned, polished, waxed or the like depending on the material of at least one cleaning cloth 42 used.

The present invention may allow for a user to be safe, comfortable and efficient as well. In usage, the present invention functions as follows. First, user U puts on and wears knee pads 22 by conventional means, preferably around each knee. Knee pads 22 include cushion 24 to provide protection and comfort to user U. Subsequently, one of at least one cleaning cloth 42 may be mounted to knee pads 22 with attaching members 26 on knee pads 22 and at least one cleaning cloth 42 that cooperate with each other. At least one cleaning pad 42 allows for cleaning of ground surface 62. User U may then get on their knees on ground surface 62 and move around to complete other tasks as necessary. The movement of user U on ground surface will be necessary for other tasks and result in ground surface 62 being cleaned simultaneously, which helps to increase the efficiency and effectiveness of user U. Other tasks may be tasks, such as making repairs while on the knees or reaching low areas. The present invention may also aid user U already cleaning ground surface 62 with more cleaning abilities. The present invention helps to facilitate that jobs and tasks of user U.

The foregoing description conveys the best understanding of the objectives and advantages of the present invention. Different embodiments may be made of the inventive concept of this invention. It is to be understood that all matter disclosed herein is to be interpreted merely as illustrative, and not in a limiting sense.

What is claimed is:

1. A system for a cleaning device, comprising:

a) a knee pad assembly including knee pads, said knee pads including a tubular fabric portion configured to receive a user's leg therein, the tubular fabric portion thereby adapted to surround said user's knee, said knee pads further including a front side having a cushion embedded within, the knee pads including a stitching completely surrounding said cushion, wherein the stitching defines four perimeter edges of the cushion, the knee pads including knee pad attachment members, wherein the knee pad attachment members are located entirely within the four perimeter edges of the cushion; and b) a cleaning device assembly including a cleaning cloth, said cleaning cloth including cleaning cloth attachment members, wherein the cleaning cloth attachment members cooperate with said knee pad attachment members for removably mounting the cleaning cloth to the knee pads, said cleaning cloth being made of microfiber, said knee pads and said cleaning cloth being washable and reusable, said cleaning cloth being absorbent, said cleaning cloth attachment members being located on a rear outer surface thereof.

2. The system of claim 1, wherein said cushion is made of foam, rubber, plastic, gel, carbon fiber or combinations thereof.

3. The system of claim 1, wherein said at least one knee pad is made of cotton, linen, rayon, silk, polyester, nylon or combinations thereof.

4. The system of claim 1, wherein each of said knee pad attachment members and cleaning cloth attachment members are one of hook and loop fasteners, adhesives, or snap buttons.

5. The system of claim 1, wherein said cleaning cloth is interchangeable.

6. The system of claim 1, wherein said knee pad attachment members are two parallel strips of hook and loop fasteners.

7. The system of claim 1, wherein the cleaning cloth attachment members are two parallel strips of hook and loop fasteners.

8. The system of claim 1, wherein the cleaning cloth includes four perimeter sides.

9. A system for a cleaning device, consisting of:

a) a knee pad assembly including knee pads, said knee pads including a tubular fabric portion configured to receive a user's leg therein, the tubular fabric portion thereby adapted to surround said user's knee, said knee pads further including a front side having a cushion embedded within, the knee pads including a stitching completely surrounding said cushion, wherein the stitching defines four perimeter edges of the cushion, the knee pads including knee pad attachment members, wherein the knee pad attachment members are hook and loop straps located entirely within the four perimeter edges of the cushion; and b) a cleaning device assembly including a cleaning cloth, said cleaning cloth including cleaning cloth attachment members, wherein the cleaning cloth attachment members are hook and loop fasteners that cooperate with said hook and loop straps on said knee pads for removably mounting the cleaning cloth to the knee pads, said cleaning cloth being made of microfiber, said knee pads and said cleaning cloth being washable and reusable, said cleaning cloth being absorbent, said hook and loop fasteners on the cleaning cloth being on a rear outer surface thereof.

* * * * *